US005155317A

United States Patent [19]

Lee

[11] Patent Number: 5,155,317

[45] Date of Patent: Oct. 13, 1992

[54] MICRO WAVE LEAKAGE PREVENTING APPARATUS FOR MICRO WAVE OVEN

[75] Inventor: Eung-Sup Lee, Kyonggi-do, Rep. of Korea

[73] Assignee: Samsung Electronics Co., Ltd., Kyonggi-do, Rep. of Korea

[21] Appl. No.: 810,188

[22] Filed: Dec. 19, 1991

[30] Foreign Application Priority Data

Dec. 21, 1990 [KR] Rep. of Korea ..... 90-21390

[51] Int. Cl.[5] ..... H05B 6/76

[52] U.S. Cl. ..... 219/10.55 D; 219/10.55 F

[58] Field of Search ..... 219/10.55 D, 10.55 E, 219/10.55 F; 174/35 R

[56] References Cited

U.S. PATENT DOCUMENTS

| | | | |
|---|---|---|---|
| 4,053,730 | 10/1977 | Baron et al. | 219/10.55 F |
| 4,132,239 | 1/1979 | Bowen et al. | 219/10.55 D |
| 4,303,817 | 12/1981 | Klement et al. | 219/10.55 D |
| 4,313,044 | 1/1982 | Staats | 219/10.55 D |
| 4,800,246 | 1/1989 | Lee et al. | 219/10.55 F |
| 4,845,327 | 7/1989 | Iwabuchi et al. | 219/10.55 F |

FOREIGN PATENT DOCUMENTS

| | | | |
|---|---|---|---|
| 60-118894 | 8/1985 | Japan . | |
| 1-255189 | 10/1989 | Japan | 219/10.55 D |

*Primary Examiner*—Philip H. Leung

*Attorney, Agent, or Firm*—Burns, Doane, Swecker & Mathis

[57] ABSTRACT

A microwave oven includes a heating space in which a motor-driven turn-table is disposed. A drive shaft for the turn-table extends upwardly through the floor. A shielding member is mounted to the underside of the floor and includes a horizontal wall portion having a second hole through which the drive shaft extends. A plurality of reflectors are upstanding from the horizontal wall portion and are circumferentially spaced about the second hole. The reflectors reflect microwaves toward the floor to dampen the microwaves. Slots formed in the horizontal wall portion outside of the reflectors conduct heat to a chamber located below the horizontal wall portion in which a motor is mounted for rotating the drive shaft.

13 Claims, 2 Drawing Sheets

FIG. 1
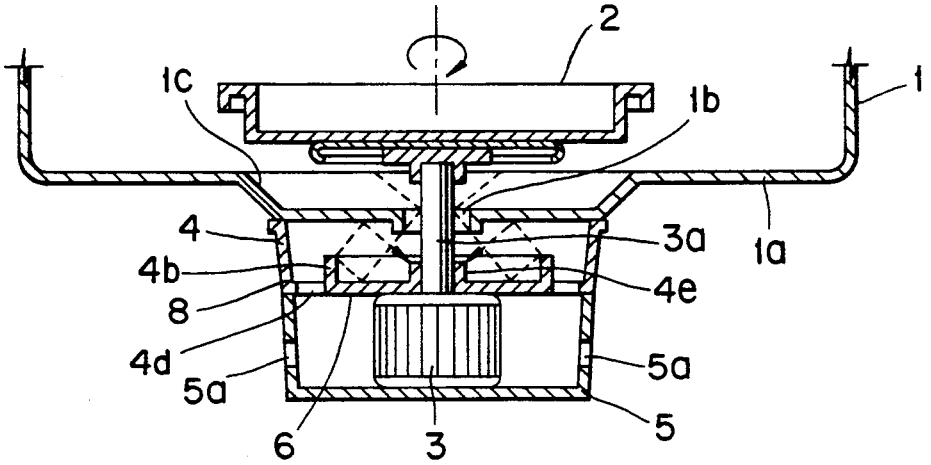
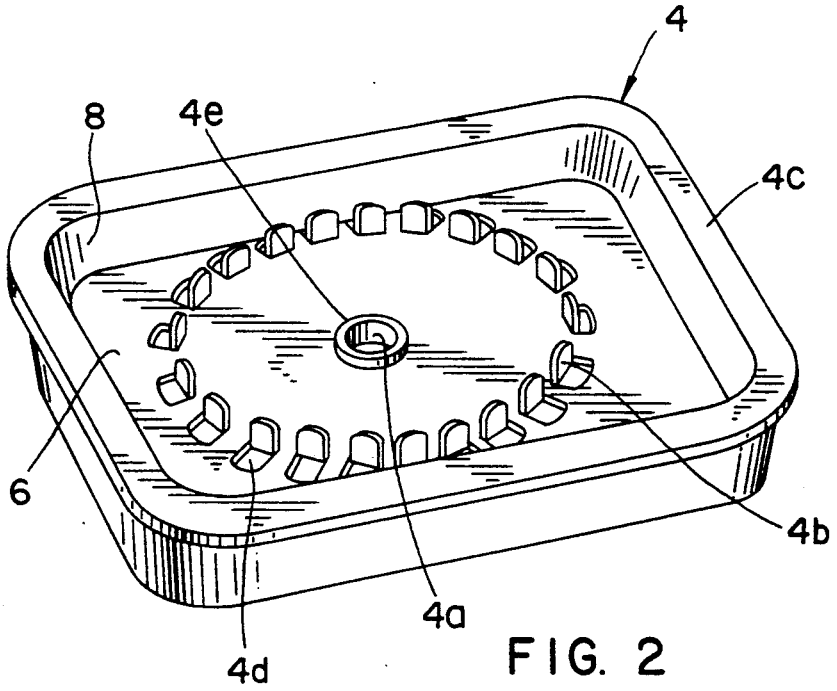
FIG. 2

MICRO WAVE LEAKAGE PREVENTING APPARATUS FOR MICRO WAVE OVEN

FIELD OF THE INVENTION

The present invention relates to a micro wave leakage preventing apparatus for a micro wave oven, in which micro waves in a heating room are shielded so as not to be leaked to the outside, so that adverse influences should not be given to the surrounding portions of the motor and to humans.

BACKGROUND OF THE INVENTION

In the conventional micro wave ovens, a motor shaft resolves by receiving a driving power from a motor which is installed below and outside the bottom of a heating room, and this motor shaft passes through the bottom wall of the heating room in order to rotate a turn table which is installed concentrically within the heating room and at a proper height. Therefore, the micro wave which are introduced into the heating room are leaked through the through-hole formed on the bottom of the heating room, with the result that the surrounding portions of the motor are heated by the leaked micro waves, thereby causing over-heatings and malfunctions on them. Further, the micro waves which are leaked to the outside can harm humans.

In an attempt to overcome the above described problems, there has been proposed a micro wave leakage preventing apparatus which is constituted as shown in FIG. 3, and as described below. That is, a turn table 11, which is to be rotated and to mount foods within the heating room 10 (into which micro waves are supplied), receives a driving power from a motor 12 which is installed concentrically with the turn table at the outside of the heating room 10. The turn table 11 revolves by being driven by a motor shaft 12*a* which passes through a through-hole 10*b* formed on a bottom 10*a* of the heating room 10. A motor supporting member 13 is fitted to the motor shaft 10*a* and between the motor 12 and the bottom wall 10*a* of the heating room 10 enabling the member 13 to be disposed on the top of the motor 12. A first shielding member 14 having the shape of a funnel is disposed on the motor supporting member 13, and the lower end portion of the first shielding member 14 is fitted to the motor shaft 12*a*, while a dish shaped second shielding member 15 with a through-hole formed thereon is weld-fixed to the leading end of the first shielding member 13. Meanwhile the top of the second shielding member 15 is weld-fixed to the bottom 10*a* of the heating room 10.

In the apparatus as described above, the first shielding member 14 is installed in contact with the motor shaft 12*a*, and the second shielding member 15 is weld-fixed under the through-hole 10*b* which is formed on the bottom wall 10*a* of the heating room 10, as well as being weld-fixed to the first shielding member 14. Thus it becomes possible to shield up the micro waves which are leaked through the through-hole 10*b* of the heating room 10. However, it is impossible to suppress in a natural manner the reflection of micro waves from the first and second shielding members 14, 15, even though the heating room is sealed up. Therefore, the heat which is accumulated as the result of the reflections of the micro waves elevates the temperatures of the surrounding portions of the motor 12, thereby leaving the problem of malfunctions as before.

Meanwhile, in an attempt to overcome the conventional problems, there is proposed another micro wave leakage preventing apparatus which is disclosed in Japanese Utility Model, Laid-Open Publication No. 60-118894. In this apparatus, the turn table which mounts foods and rotates the foods within the heating room is interlocked with a motor shaft which transfers a driving power from a motor which is concentrically installed with the shaft. Further, a roller supporting member is formed on the bottom of the heating room in such a manner that the roller supporting member should be able to movably support in the radial direction a supporting roller which moves around the revolution axis of the turn table to movably support the turn table. Further, a reflecting member which moves together with the supporting roller in the radial direction in order to reflect the micro waves is fixedly secured to the supporting shaft of the supporting roller.

However, in the apparatus as described above, the supporting roller moves to the left and right by being guided by the roller supporting member which has a concavely recessed portion and a rectangular trace on the bottom of the heating room. In accordance with the movements of the supporting roller, the reflecting member moves in an interlocked manner in order to reflect micro waves, and therefore, the micro waves which are concentrated to the lower portion of the turn table can be dispersed. However, a part of micro waves is leaked through the clearance of the through-hole through which the motor shaft is inserted. Thus, the portions surrounding the motor are elavated in their temperatures, thereby causing malfunctions of the surrounding portions and fatal harms to human bodies.

SUMMARY OF THE INVENTION

The present invention is intended to overcome the above described disadvantages of the conventional techniques.

Therefore it is the object of the present invention to provide a micro wave leakage preventing apparatus for the micro wave oven, in which the micro waves are prevented from being leaked through the motor driving portion from the heating room to enable the micro waves to naturally disappear, thereby preventing the malfunctions caused by the temperature elevation, and also preventing harmful effects given to human bodies.

In achieving the above object, the micro wave leakage preventing apparatus for a micro wave oven according to the present invention includes: a heating room for receiving micro waves in order to heat up foods; a turn table for mounting foods within the heating room; a motor having a motor shaft, with the motor shaft being concentrically installed below the heating room to rotate the turn table after pasing through a through-hole of the bottom wall of the heating room; a shielding member installed between the motor and the bottom wall of the heating room in such a manner as to shield the micro waves leaked through the through-hole.

The micro wave leakage preventing apparatus according to the present invention is further characterized in that: the shielding member is provided with a flange on the upper edge thereof, with a through-hole being formed at the center of the bottom of the shielding member, and with a bent portion being formed along an edge of the through-hole so as for the motor shaft to be wrapped by the bent portion; a plurality of shielding protuberances are disposed around the through-hole in a circular form with a proper height and at a proper radial distance; slots are formed at positions radially outwardly from the shielding protuberances, with the slots being formed during the press-forming of the shielding protuberances; and the micro waves leaked through the through-hole are randomly reflected from the shielding member so as for the randomly reflected waves to be naturally suppressed. Thus the malfunctions which are liable to occur due to the temperature elevation caused by the leaked waves can be prevented, because micro waves are not leaked to the outside.

BRIEF DESCRIPTION OF THE DRAWINGS

The above object and other advantages of the present invention will become more apparent by describing in detail the preferred embodiment of the present invention with reference to the attached drawings in which:

FIG. 1 is a sectional view of a lower portion of a micro wave oven showing a shielding mechanism according to the present invention;

FIG. 2 is a perspective view of the shielding member according to the present invention.

DESCRIPTION OF THE PREFERRED EMBODIMENT

Figure 3:
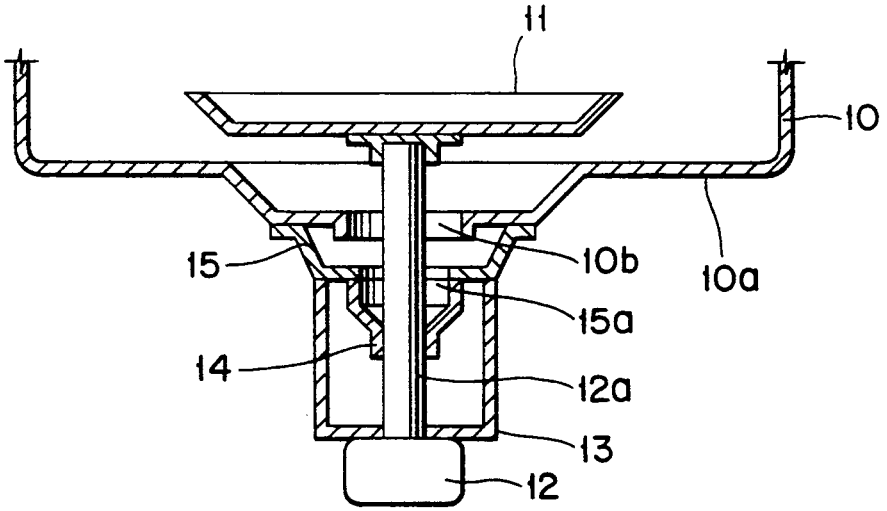
FIG. 3 PRIOR ART
FIG. 3 is a sectional view through a conventional shielding member.

Referring to FIGS. 1 and 2, reference numeral 1 indicates a heating room in which foods are heated by means of micro waves supplied from a magnetron (not shown). At the bottom 1*a* of the heat room 1, there is provided a recess 1*c* which is formed by pressing, and, above the recess 1*c*, there is installed a turn table 2 for mounting foods at a proper height. A through-hole 1*b* is formed at the center of the recess 1*c*, and a motor shaft 3*a* passes through the through-hole 1*b*, while the motor shaft 3*a* is connected concentrically to a motor 3 which is installed below and at the outside of the heating room.

Below and at the outside of the recess 1*c*, there is installed a shielding member 4 which has a cylindrical or rectangular shape, and this shielding member 4 is secured between the top of the motor 3 and the bottom of the recess 1*c* (which is formed on the bottom of the heating room 1), in such a manner that the member 4 should be able to shield off or naturally suppress the micro waves which are leaked through the through-hole 1*b* of the recess 1*c*.

The shielding member 4 includes a generally horizontal wall portion 6 and an upwardly extending flange portion 8. The latter provided with a flange 4*c* in an outwardly bent form at its upper edge, and a through-hole 4*a* is formed at the center of the horizontal wall portion 6, with a bent portion 4*e* being formed along the edge of the through-hole 4*a* in order to wrap the motor shaft 3*a*. Around the through-hole 4*a* and at a proper radial distance from the hole 4*a*, there are formed in the horizontal wall portion 6 a plurality of upstanding shielding protuberances or reflectors 4*b*. The protuberances have a height which is less than the vertical spacing between the floor and the horizontal wall portion 6. The protuberances are spaced circumferentially about the hole 4*a* in a circular pattern. At outer positions from the shielding protuberances 4*b*, there are formed slots 4*d* as many as the shielding protuberances 4*b*, these slots being produced during the blanking of the shielding protuberances by a press. These slots 4*d* serve as the heat releasing holes when heat is produced in the space between the bottom 4*a* and the shielding member 4 by the micro waves which are leaked through the through-hole 1*b*.

Further, under the shielding member 4, there is fixedly secured a motor supporting member 5 which supports the motor 3, and which is provided with a plurality of ventilation holes 5*a* on the circumferential surface of it.

The apparatus of the present invention constituted as above will now be described as to its operation and effects.

As shown in FIGS. 1 and 2, if the user pushes a selecting button (not shown) of a control section (not shown) in order to use the micro wave oven, then a control signal is supplied to the motor 3 to activate the motor 3. Then a driving power is transmitted from the motor through the motor shaft to the turn table 2 to drive the turn table 2, and, under this condition, the food mounted upon the turn table is cooked by being heated by the micro waves emitted from a micro wave supplying device (not shown) which is installed on the ceiling or side wall of the heating room.

The motor shaft 3*a* which passes through the through-hole 1*b* and rotates the turn table 2 has a diameter smaller than that of the through-hole 1*b* so as for the shaft 3*a* to revolve without being contacted with the side of the through-hole 1*b*. Therefore, the micro waves which are introduced into the heating room 1 are leaked through between the motor shaft 3*a* and the through-hole 1*b* to the outside of the heating room 1.

Under this condition, the micro waves which are leaked through between the motor shaft 3*a* and the through-hole 1*b* are suppressed in a natural manner after being shielded by the shielding member 4 which is fixedly secured under the bottom 1*a* of the heating room 1. That is, the micro waves which are leaked in the above described manner are reflected after being collided with a the shielding protuberances 4*b* which are formed around the through-hole 4*a* of the shielding member 4 in a circular form. Then the reflected waves are reflected again at the bottom 1*a* of the heating room 1, and this cycle is repeated, so that the waves should be damped and suppressed in a natural manner. The heat which is accumulated during this process is released through the slots 4*d* of the shielding member 4 and through ventilating holes 5*a* of the motor supporting member 5 to the outside. Thus the temperature elevations on the portions surrounding the motor 3 can be prevented, and the micro waves can be prevented from being leaked to the outside in a sure manner.

According to the micro wave leakage preventing apparatus of the present invention as described above, the micro waves which are leaked through between the motor shaft and the through-hole are repeatedly reflected to and fro between the shielding protuberances of the shielding member and the bottom of the heating room, with the result that the leaked micro waves are damped to be suppressed in a natural manner through the repeated collisions. Therefore, the temperature elevations on the portions surrounding the motor, as well as their malfunctions, can be prevented, and the possibility that humans can be affected by the harmful effects of the waves can also be prevented.

What is claimed is:

1. A microwave oven comprising:

a heating room for receiving microwaves in order to heat foods, and including a floor;

a turn-table disposed within said heating room;

a drive shaft extending upwardly through a first hole in said floor and operably connected to said turn-table;

a motor connected to a lower end of said drive shaft for rotating said turn-table;

a shielding member disposed between said floor and said motor, said shielding member including:

a wall including a portion spaced downwardly from said floor and including a second hole through which said drive shaft extends;

a plurality of reflectors upstanding from said portion and spaced apart annularly around said second hole at a radial distance therefrom for reflecting microwaves toward said floor.

2. A microwave oven according to claim 1 including aperture means formed in said shielding member outside of said reflectors for conducting heat.

3. A microwave oven according to claim 2, wherein said reflectors are press-formed from said portion of said wall, said aperture means comprising a plurality of slots defined by the press-forming of said reflectors.

4. A microwave oven according to claim 2, wherein said aperture means is formed in said portion of said wall.

5. A microwave oven according to claim 4 including a second shielding member situated below said first-named shielding member and forming a chamber in which said motor is disposed said aperture means communicating with said chamber.

6. A microwave oven according to claim 1, wherein said second hole is formed by a bent-up portion of said portion of said wall.

7. A microwave oven according to claim 1, wherein said reflectors have a height shorter than a vertical spacing between said floor and said portion of said wall.

8. A microwave oven according to claim 1, wherein said reflectors have a height shorter than a vertical spacing between said floor and said portion of said wall, slots formed in said portion of said wall radially outside of said reflectors, a second shielding member disposed below said first-named shielding member and forming a chamber in which said motor is disposed, said slots communicating with said chamber for conducting heat thereto.

9. A microwave oven according to claim 1, wherein said shielding member includes an upstanding flange extending upwardly from an outer periphery of said portion of said wall and connected to said floor.

10. A microwave oven according to claim 9, wherein an upper edge of said upstanding flange is bent horizontally.

11. A microwave oven comprising:

a heating room for receiving microwaves in order to heat foods, and including a floor;

a turn-table disposed within said heating room;

a drive shaft extending upwardly through a first hole in said floor and operably connected to said turn-table;

a motor connected to a lower end of said drive shaft for rotating said turn-table;

first shielding means disposed between said floor and said motor and including:

a wall including a portion spaced downwardly from said floor and including a second hole through which said drive shaft extends, and an upstanding flange extending upwardly from an outer periphery of said portion and connected to said floor;

reflector means upstanding from said portion of said wall and extending annularly around said second hole at a location radially outwardly therefrom for reflecting microwaves toward said floor; and aperture means formed in said wall radially outside of said reflector means;

second shielding means disposed below said first shielding means and forming a chamber in which said motor is disposed, said aperture means communicating with said chamber to conduct heat thereto.

12. A microwave oven according to claim 11, wherein said reflector means comprise circumferentially spaced reflectors.

13. A microwave oven according to claim 12, wherein said reflectors have a height shorter than a vertical spacing between said floor and said portion of said wall.

* * * * *